US006471108B1

(12) United States Patent
Shi

(10) Patent No.: US 6,471,108 B1
(45) Date of Patent: Oct. 29, 2002

(54) AUDIO AND VIDEO EFFECT STAPLER

(75) Inventor: Chien-Fa Shi, Hsinchu (TW)

(73) Assignee: Green Lake Enterprise Co., Ltd., Hsinchu (TW)

( * ) Notice: Subject to any disclaimer, the term of this patent is extended or adjusted under 35 U.S.C. 154(b) by 0 days.

(21) Appl. No.: 09/993,571

(22) Filed: Nov. 27, 2001

(51) Int. Cl.[7] ..... B25C 1/04
(52) U.S. Cl. ..... 227/134; 227/156; 173/20
(58) Field of Search ..... 227/120, 134, 227/156, 155; 173/20, 21

(56) References Cited

U.S. PATENT DOCUMENTS 4,925,082 A * 5/1990 Kim ..... 227/120
5,690,268 A * 11/1997 Evans et al. ..... 227/156
5,992,724 A * 11/1999 Snyder ..... 227/134
6,152,347 A * 11/2000 Wilson et al. ..... 227/134
6,286,745 B1 * 9/2001 Ackeret ..... 227/156
6,338,430 B1 * 1/2002 Cheng ..... 227/134

* cited by examiner

*Primary Examiner*—Scott A. Smith
(74) *Attorney, Agent, or Firm*—Bacon & Thomas, PLLC

(57) ABSTRACT

An audio and video effect stapler comprising a base. One end of the base is pivotally installed with a bind clip groove. Another ejecting seat is pivotally installed on the base. By pressing the ejecting seat, a bind clip protrudes out for binding papers. An audio and video device is installed in the space formed by the base and the ejecting seat. Another end of the base is connected to a touch switch of the audio and video device. The inner lateral surface of the ejecting seat is installed with a press corresponding to the touch switch. As the press binds clip protrudes out. The press exactly presses on the touch switch so that the audio and video device emits sound and light for increasing the interest of using a stapler and the stapler has an effect of decoration.

4 Claims, 3 Drawing Sheets

AUDIO AND VIDEO EFFECT STAPLER

FIELD OF THE INVENTION

The present invention relates to a stapler, and particularly to an audio and video effect stapler which present audio and video effects and thus present an interesting effect.

BACKGROUND OF THE INVENTION

With the development of technology, human life has improved greatly. Nowadays, processors and memories have widely used in many fields so as to manufacture more powerful tools. Especially in audio and video devices, more and more devices are added with audio and video effects so as to present a vivid effect to the users.

Staplers are a simple and widely used prior art tools, which are helpful in the document process in the conventional way. However, many new designs about the staplers have been developed, while all such develops are used to enhance the function about binding bind clips instead of enhancing other effects, such as shapes, audio and video effects.

SUMMARY OF THE INVENTION

Accordingly, the primary object of the present invention is to provide an audio and video effect stapler, which combines the conventional stapler and current audio and video technology so as to present a vivid effect to users.

To achieve about object, the present invention provides an audio and video effect stapler comprises the following elements. A base has an end pivotally installed with a bind clip groove. Another ejecting seat is pivotally installed on the base, which is coaxially installed with the bind clip groove. By pressing the ejecting seat, bind clip protrudes out for binding papers. An audio and video device is installed in the space formed by the base and the ejecting seat. Another end of the base is connected to a touch switch of the audio and video device. The inner lateral surface of the ejecting seat is installed with a press corresponding to the touch switch. As the press is pressed and bind clip protrudes out. The press exactly presses on the touch switch so that the audio and video device emits sound and light for increasing the interest of using a stapler and the stapler has an effect of decoration.

The various objects and advantages of the present invention will be more readily understood from the following detailed description when read in conjunction with the appended drawing.

DESCRIPTION OF THE PREFERRED EMBODIMENTS

Figure 1:
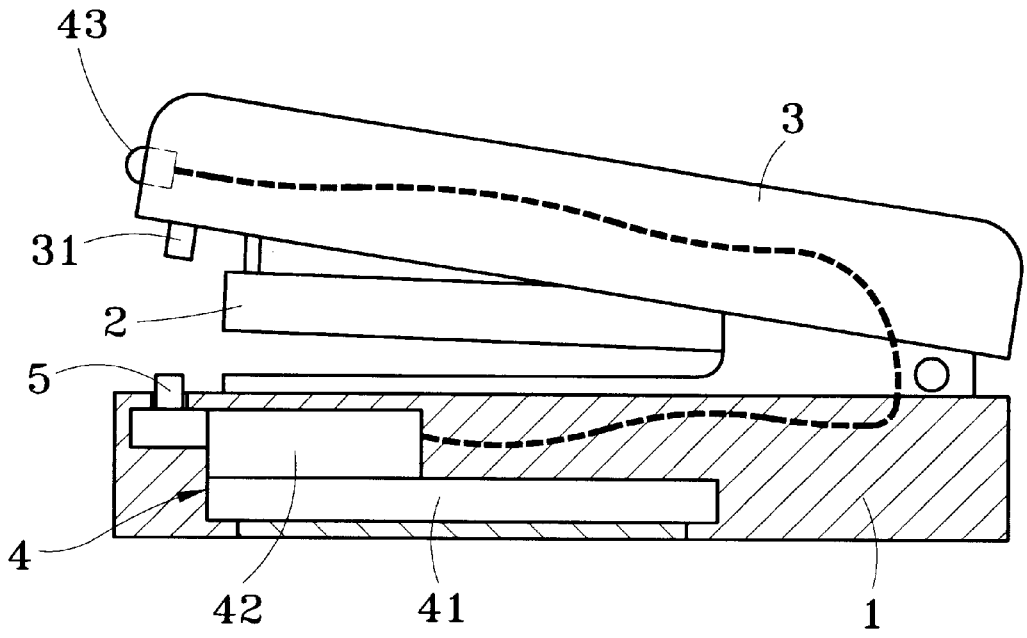
FIG. 1 is a schematic cross section view of the present invention.

Referring to FIG. 1, the cross section view of the present invention is illustrated. The audio and video effect stapler of the present invention includes a base 1. One end of the base 1 is pivotally installed with a bind clip groove 2 for placing the bind clips. Another ejecting seat 3 is pivotally installed on the base 1, which is coaxially installed with the bind clip groove 2. By pressing the ejecting seat 3, bind clip (not shown) can protrude out for binding papers. An audio and video device 4 is installed in the space formed by the base 1 and the ejecting seat 3. A front end of the base 1 is connected to a touch switch 5 of the audio and video device 4. The inner lateral surface of the ejecting seat 3 is installed with a press 31 corresponding to the touch switch 5. As the press 31 is pressed and bind clip protrudes out, the press 31 in the ejecting seat 3 exactly presses on the touch switch 5 so that the audio and video device 4 connected to the touch switch 5 emits sound and light for increasing the interest of using a stapler and the stapler has an effect of decoration. Besides, the audio and video device 4 includes a speaker 41 arranged in the base 1, a light emitting device 43 on the surface of the ejecting seat 3, and a control circuit 42 connected to the speaker 41 and the light emitting device 43. By the control circuit 42 to receive the signal from the touch switch 5, the speaker 41 and the light emitting device 43 will present audio and video effects.

Figure 2:
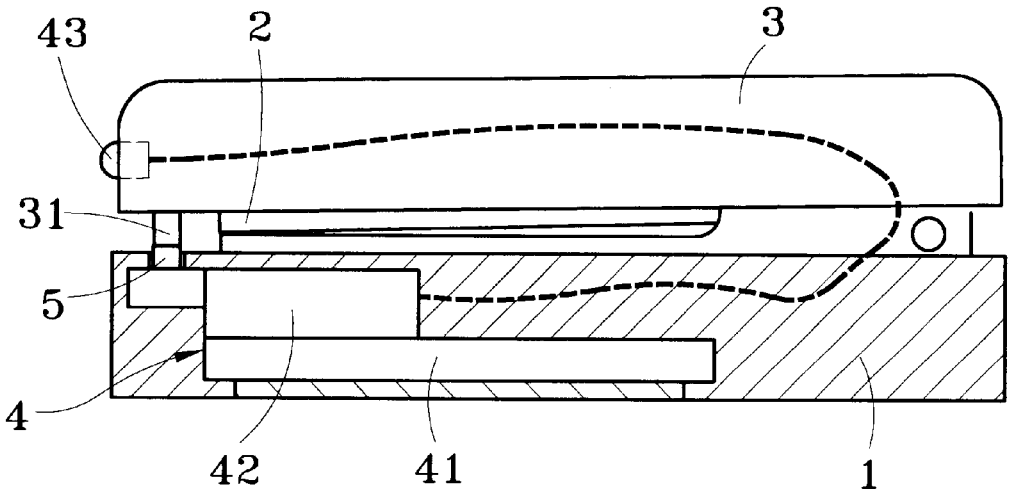
FIG. 2 is a schematic view of the present invention.

With reference to FIG. 2, a schematic view showing the application of the present invention is illustrated. In using, the user presses the ejecting seat 3, the bind clip is ejected from the bind clip groove 2, and then, the press 31 in the ejecting seat 3 exactly contacts the touch switch 5. Then, the audio and video device 4 is actuated, and preset sound or music is emitted from the speaker 41 at the bottom of the base 1. Meanwhile, the light emitting device 43 on the surface of the ejecting seat 3 emits light according to a predetermined way. Therefore, sound and video effects are presented.

Figure 3:
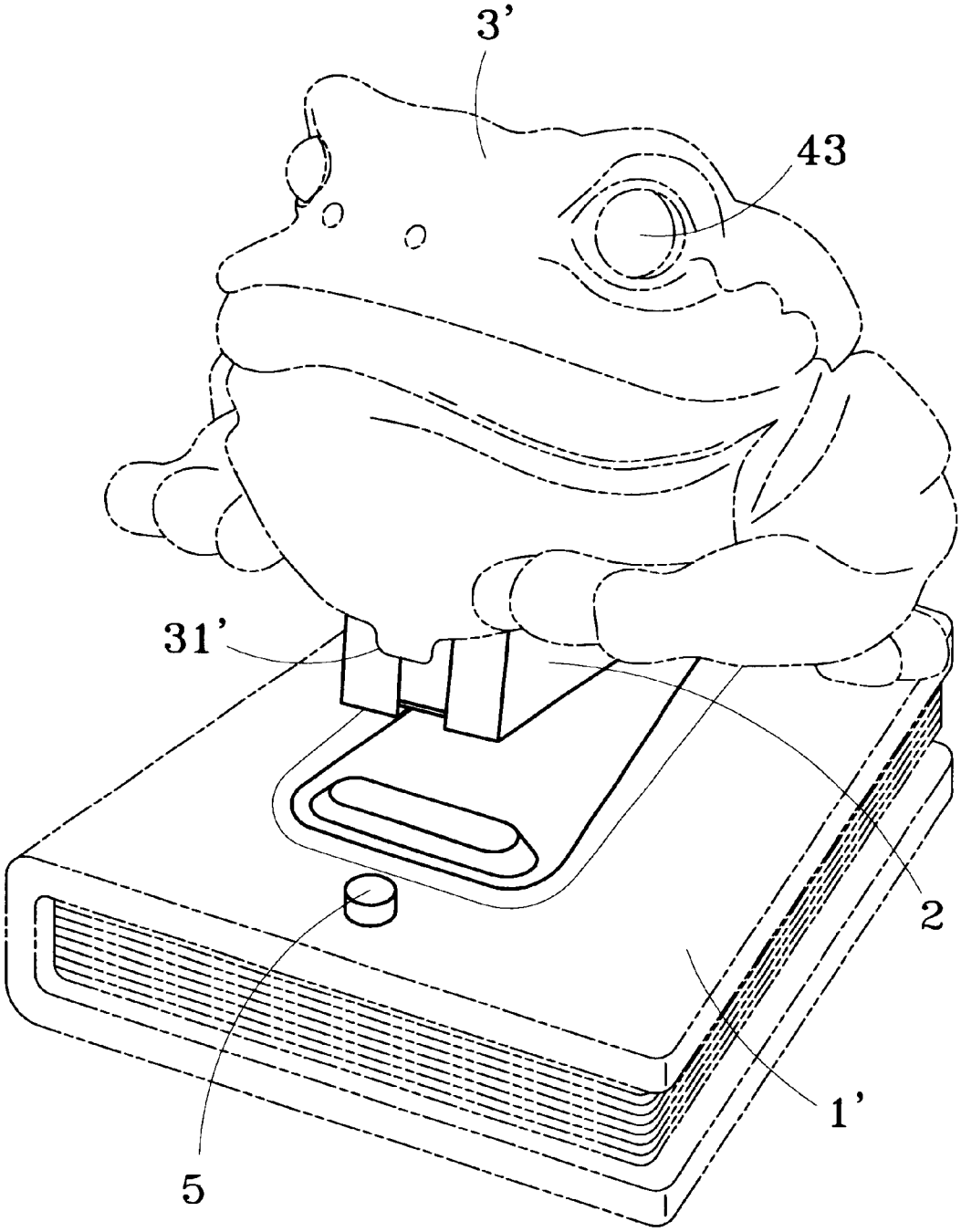
FIG. 3 shows one embodiment of the present invention.

In manufacturing process, referring to FIG. 3, an embodiment of the present invention is illustrated. In enhancing the beauty and decoration of the present invention, the base 1' and ejecting seat 3' can be made with a shape like an animal, a plant, or a general used product. A control circuit 42 and speaker 41 are embedded in the base 1'. A front end of the base 1 is arranged with a protruded touch switch 5. At least one light emitting device 43 is installed at a predetermined position of the ejecting seat 3'. Besides, in forming a mold, the press 31' can be directly installed to the ejecting seat 3' so that as the ejecting seat 3' is pressed downwards, the touch switch 5 can be pressed. Meanwhile, to match the shape of the base 1' and the ejecting seat 3', the audio and video device 4 may emit preset sound and special light. Referring to FIG. 3, a shape of a frog is illustrated. The audio and video device 4 may simulate the sound of a frog, and the light emitting device 43 is formed as eyes of the frog. Therefore, the bind clip will present a vivid shape.

Figure 4:
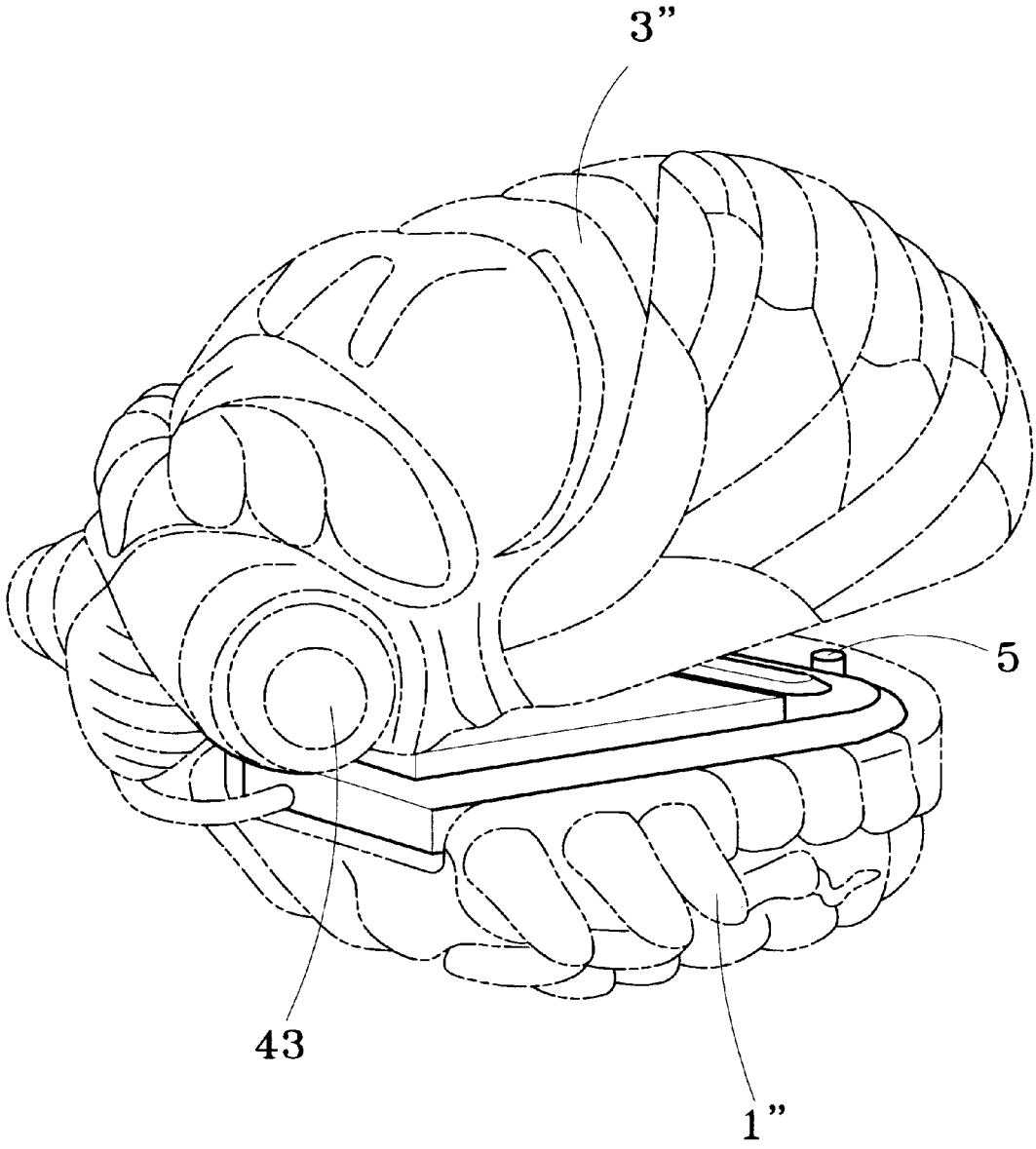
FIG. 4 shows another embodiment of the present invention.

Moreover, referring to FIG. 4, a schematic view of another embodiment of the present invention is illustrated. The ejecting seat 3" and base 1" have a shape like a cicadas and the audio and video device 4 may simulate the sound of the cicadas. The light emitting device 43 is formed as eyes of the cicadas. Therefore, the present invention may be formed as an animal or a plant or a general shape and the audio and video effects are matched with the shape.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An audio and video effect stapler comprising a base; one end of the base being pivotally installed with a bind clip groove for placing the bind clips; another ejecting seat being pivotally installed on the base, which is coaxially installed with the bind clip groove; by pressing the ejecting seat, bind clip protruding out for binding papers, wherein:

an audio and video device is installed in the space formed by the base and the ejecting seat; a front end of the base is connected to a touch switch of the audio and video device; an inner lateral surface of the ejecting seat is installed with a press corresponding to the touch switch; as the press is pressed and then the bind clip protrudes out, the press in the ejecting seat exactly presses on the touch switch so that the audio and video device connected to the touch switch emits sound and light for increasing the interest of using a stapler and the stapler has an effect of decoration.

2. The audio and video effect stapler as claim in claim 1, wherein the audio and video device includes a speaker arranged in the base, a light emitting device on a surface of the ejecting seat, and a control circuit connected to the speaker and the light emitting device; by the control circuit to receive the signal from the touch switch, the speaker and the light emitting device will present audio and video effects.

3. The audio and video effect stapler as claim in claim 1, wherein the base and ejecting seat is made with a shape like an animal, a plant, or a general used product.

4. The audio and video effect stapler as claim in claim 1, wherein the light emitting device is a bulb or an LCD.

* * * * *